US009062511B2

(12) United States Patent
Gette et al.

(10) Patent No.: US 9,062,511 B2
(45) Date of Patent: Jun. 23, 2015

(54) SOFT SKIN METAL SEAL AND TECHNIQUE OF MANUFACTURE

(75) Inventors: Nicholas P. Gette, Houston, TX (US); Stanley Drozdowski, Cypress, TX (US)

(73) Assignee: Vetco Gray Inc., Houston, TX (US)

( * ) Notice: Subject to any disclaimer, the term of this patent is extended or adjusted under 35 U.S.C. 154(b) by 684 days.

(21) Appl. No.: 13/275,884

(22) Filed: Oct. 18, 2011

(65) Prior Publication Data

US 2013/0093140 A1 Apr. 18, 2013

(51) Int. Cl.
*E21B 33/128* (2006.01)
*E21B 33/12* (2006.01)
*E21B 33/035* (2006.01)

(52) U.S. Cl.
CPC ..... *E21B 33/035* (2013.01)

(58) Field of Classification Search
CPC .. E21B 33/035; E21B 2033/005; E21B 33/04
USPC ..... 277/323, 328, 337–339
See application file for complete search history.

(56) References Cited

U.S. PATENT DOCUMENTS 2,050,137 A * 8/1936 Walsh ..... 285/331
4,402,773 A * 9/1983 Morrill ..... 285/25
4,457,789 A * 7/1984 Wilks ..... 148/566
4,911,245 A 3/1990 Adamek et al.
5,129,660 A * 7/1992 Taylor et al. ..... 277/328
5,685,369 A * 11/1997 Ellis et al. ..... 166/195
7,762,319 B2 7/2010 Nelson
2008/0135229 A1* 6/2008 Hunter et al. ..... 166/84.1
2010/0126736 A1 5/2010 Ellis et al.
2010/0300705 A1* 12/2010 Nelson ..... 166/387
2011/0180275 A1* 7/2011 Shaw ..... 166/387

FOREIGN PATENT DOCUMENTS

EP 2314828 A2 4/2011
GB 2484388 A 4/2012

OTHER PUBLICATIONS

Search Report from corresponding GB Application No. GB1218524.5 dated Jan. 28, 2013.

* cited by examiner

*Primary Examiner* — Vishal Patel
*Assistant Examiner* — Stacy Warren
(74) *Attorney, Agent, or Firm* — Bracewell & Giuliani LLP

(57) ABSTRACT

A seal assembly between a wellhead housing and a casing hanger, has an inner seal leg for sealing against hanger, and an outer seal leg for sealing against housing. An extension extends downward from the outer seal leg and is connected to a nose ring. The nose ring has a downward facing shoulder that rests on the hanger shoulder to provide a reaction point for setting operations. A sealing surface on the seal legs is heat treated to obtain a lower localized yield strength to provide improved sealing while maintaining mechanical load capability.

12 Claims, 2 Drawing Sheets

SOFT SKIN METAL SEAL AND TECHNIQUE OF MANUFACTURE

FIELD OF THE INVENTION

This invention relates in general to wellhead assemblies and in particular to a localized heat treating process that selectively softens the outer skin surface of a metal seal for improved sealing when deformed.

BACKGROUND OF THE INVENTION

Seals are used between inner and outer wellhead tubular members to contain internal well pressure. The inner wellhead member may be a casing hanger located in a wellhead housing and that supports a string of casing extending into the well. A seal or packoff seals between the casing hanger and the wellhead housing. Alternatively, the inner wellhead member could be a tubing hanger that supports a string of tubing extending into the well for the flow of production fluid. The tubing hanger lands in an outer wellhead member, which may be a wellhead housing, a Christmas tree, or a tubing head. A packoff or seal seals between the tubing hanger and the outer wellhead member.

A variety of seals located between the inner and outer wellhead members have been employed in the prior art. Prior art seals include elastomeric and partially metal and elastomeric rings. Prior art seal rings made entirely of metal for forming metal-to-metal seals ("MS") are also employed. The seals may be set by a hydraulically activated running tool, or they may be set in response to the weight of the string of casing or tubing. One type of prior art metal-to-metal seal has seal body with inner and outer walls separated by a cylindrical slot, forming a "U" shape. An energizing ring is pushed into the slot in the seal to deform the inner and outer walls apart into sealing engagement with the inner and outer wellhead members, which may have wickers formed thereon. The energizing ring is typically a solid wedge-shaped member. The deformation of the seal's inner and outer walls exceeds the yield strength of the material of the seal ring, making the deformation permanent. However, the portion of the inner and outer seal walls may not provide the best seal possible because the metal comprising the seal is relatively hard. A dilemma however exists because the seal must also be able to handle the mechanical loads it is subjected to.

A need exists for a technique that addresses the seal issues described above. In particular, a need exists for a technique to improve the sealing capability of seals without compromising the load capacity of the seal. The following technique may solve these problems.

SUMMARY OF THE INVENTION

A heat treatment process will be applied to a sealing surface of a metal-to-metal seal used in a seal assembly. The heat treatment reduces the hardness locally at the sealing surface area. Induction heating coils that direct heat input to the sealing surface at a controlled rate are utilized. By controlling heat input to the sealing surface of the seal, it is possible to cycle between upper and lower critical transformation temperatures that result in formation of spheroidal carbides in the ferrite matrix of the seal. This microstructural change extends to a finite width established by the total sealing area and will be limited to a subsurface depth of 0.500 inches maximum. The width of softened region will be fixed but the depth will be directly proportional to duration of exposure to peak temperatures. This depth will vary relative to the amount of stock material removal that will be removed on final machining and also on the strength requirements in the sealing area. It is advantageous to reduce strength of the sealing surface to approximately a yield strength in a range of 25 to 35, while retaining a range of 50 to 70K yield strength of the base material. Base material utilized for this invention may be standard AISI G1030 low carbon steel with an as-rolled yield strength of approximately 60K.

A seal assembly is located between a wellhead housing having a bore and a casing hanger. The housing is typically located at an upper end of a well and serves as an outer wellhead member. The casing hanger has an upward facing shoulder for supporting a lower portion of the seal assembly. A metal-to-metal seal assembly has an inner seal leg with an inner wall sealing against the cylindrical wall of casing hanger and an outer seal leg with an outer wall surface that seals against wellhead housing bore. The seal surfaces have been softened by the heat treatment process explained above. The seal legs form a U-shaped pocket or slot. An extension extends downward from the outer seal leg and is connected to a nose ring having a downward facing shoulder that rests on the casing hanger shoulder to provide a reaction point for setting operations.

A lock ring retained within a recess formed in an upper interior portion of the nose ring holds the seal to the nose ring and allows for retrieval. An upward facing shoulder formed on an upper portion of the nose ring contacts the lower surface of the inner seal leg. The upward facing shoulder is contacted by the lower surface during setting operations and resists the forces exerted during setting operations.

When an energizing ring is driven into the U-shaped slot of the seal legs, the seal legs are forced outward into sealing engagement with the inner and outer wellhead members. The softened sealing surface deforms against the wellhead members. Wickers formed on the wellhead member surfaces bite into the softened sealing surfaces of the seal. This provides an improved seal.

Decoupling the hardness of the material used for sealing and the material used for handling mechanical loads allows for damage tolerance and lockdown performance combinations that are not possible with homogenous strength seals.

It is an advantage of this invention that manufacturing a varied strength seal is relatively simple and less costly than a design that attempts to achieve the same mechanical attributes through cladding with a lower strength material. Further, sealing is improved without compromising mechanical load handling capacity.

It is desirable to machine annulus seals from higher strength materials as mechanical load requirements from pressure and thermal growth continue to increase. A seal body material of varying hardness through its cross-section solves the issues by providing a relatively soft outer skin for improved wicker bite and damage tolerance while providing a harder inner shell for handling repeated extreme pressure and mechanical loads.

DETAILED DESCRIPTION OF THE INVENTION

Figure 1:
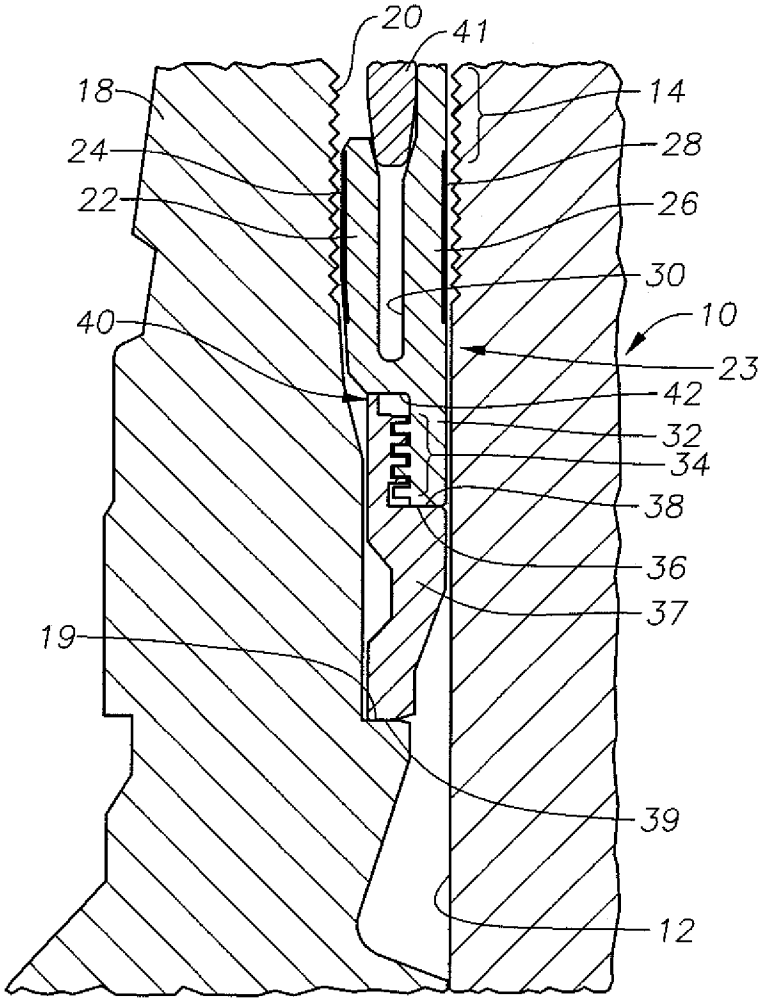
FIG. 1 is a sectional view of a seal assembly with the softened sealing area, in an unset position, in accordance with an embodiment of the invention.

Referring to FIG. 1, a portion of a seal assembly is shown between an outer wellhead member, such as a wellhead housing 10 having a bore 12 with wickers 14 formed thereon and an inner wellhead member, such as a casing hanger 18 with wickers 20 formed on an exterior portion. Housing 10 is typically located at an upper end of a well and serves as the outer wellhead member 10. Alternately, wellhead housing 10 could be a tubing spool or a Christmas tree and casing hanger 18 could instead be a tubing hanger, plug, safety valve, or other device. The casing hanger 18 has an upward facing shoulder 19 for supporting a lower portion of the seal assembly. A metal-to-metal seal assembly has an inner seal leg 22 with an inner wall 24 sealing against the cylindrical wall of casing hanger 18. Seal ring 23 has an outer seal leg 26 with an outer wall surface 28 that seals against wellhead housing bore 12. The wall surfaces 24, 28 may be curved and smooth and may be softer than the material of the remainder of the seal ring 23. The width of the softened region of the wall surfaces 24, 28 may be fixed and the depth will vary as required by the application. For example, this depth will vary relative to amount of stock material removal that will be removed on final machining of the seal ring 23 and also on the strength requirements in the sealing area. The process for achieving these softened wall surfaces 24, 28 will be explained further below.

Seal legs 22, 26 of seal ring 23 form a U-shaped pocket or slot 30. An extension 32 can extend downward from outer leg 26 and may have a threaded connection 34. The extension 32 has a downward facing shoulder 36 that rests on an upward facing shoulder 38 formed on a nose ring 37. The threaded connection 34 connects the seal ring to the nose ring 37. A lower portion 39 of the nose ring rests on the upward facing shoulder 19 of the casing hanger 18 to provide a reaction point during setting operations. An annular tab 40 protrudes upward from the nose ring 37 at a point above the threaded connection 34. The annular tab 40 contacts a lower surface 42 of the inner seal leg 22.

Figure 2:
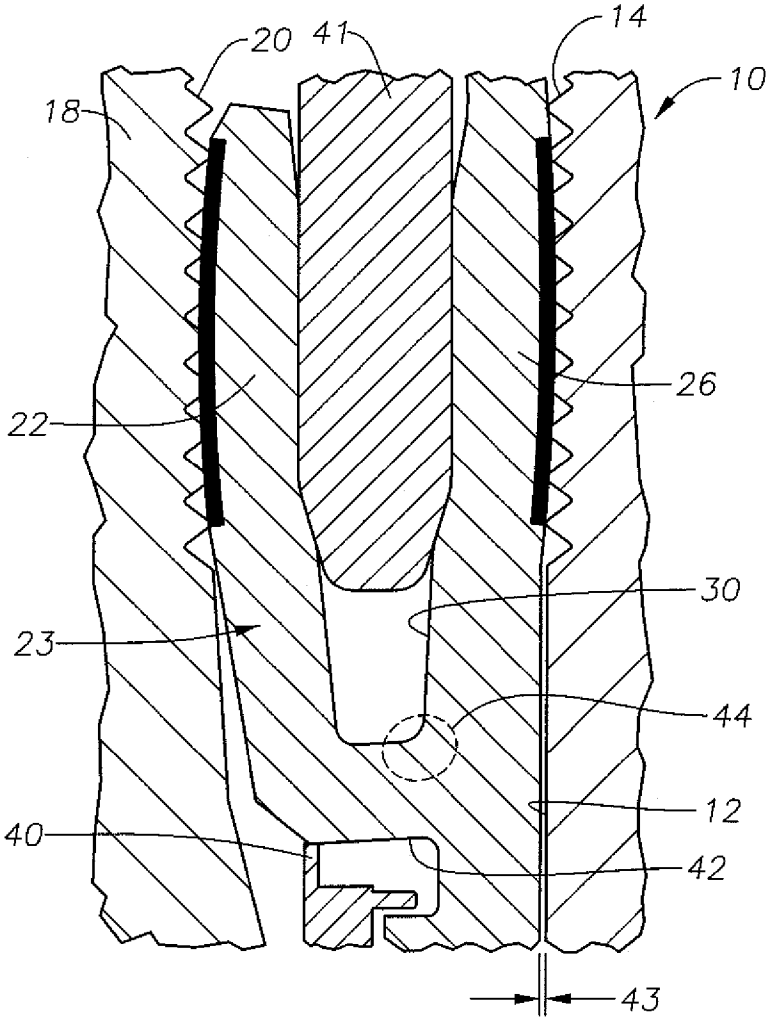
FIG. 2 is an enlarged sectional view of the seal assembly in FIG. 1 in a set position, in accordance with an embodiment of the invention.

Referring to FIG. 2, an energizing ring 41 is typically forced downward by a hydraulically actuated running tool (not shown) or the weight of a string to force it into the slot 30. The energizing ring 41 deforms the inner and outer seal legs 22, 26 of the seal body against the outer wellhead member 10 and the inner wellhead member 18. The softened wall surfaces 24, 28 of the seal legs 22, 26 facilitate their deformation against wicker profiles 14, 20 of the outer and inner wellhead members 10, 18 to effect a seal.

Figure 3:
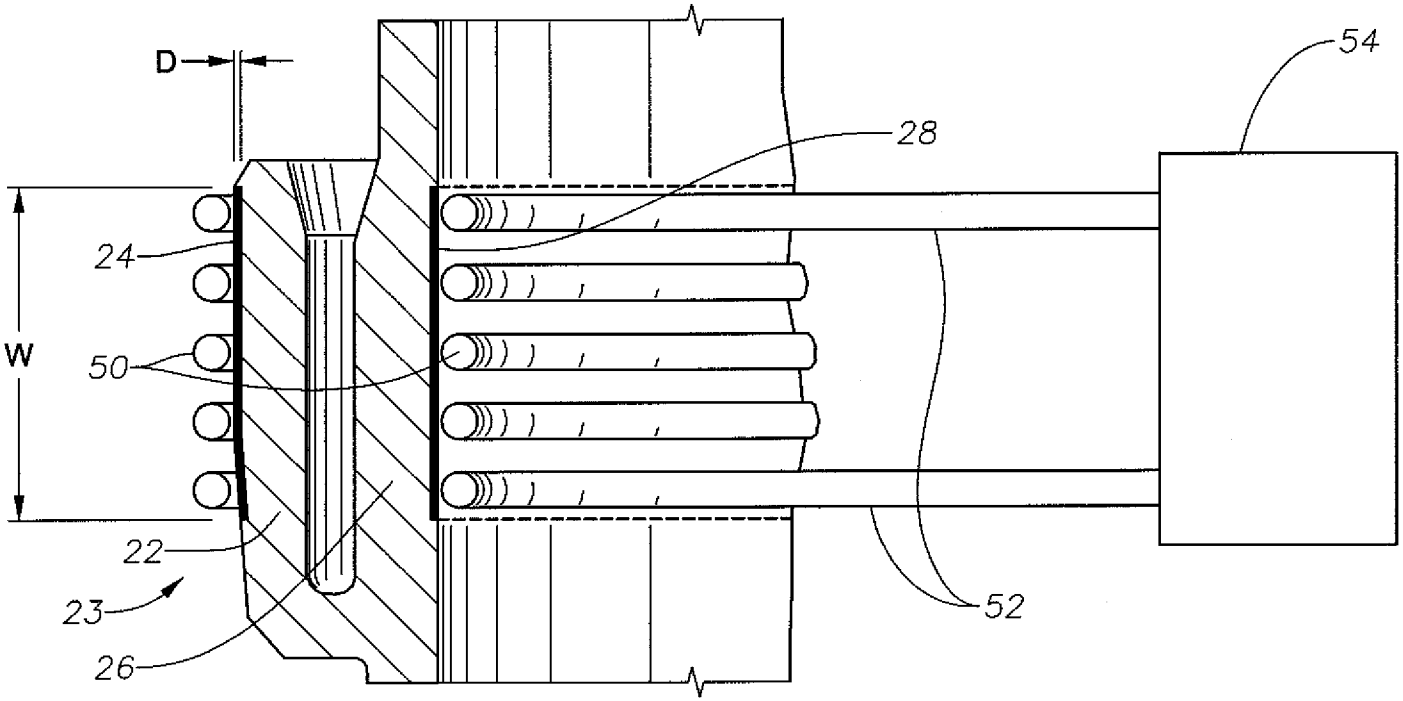
FIG. 3 is a sectional view of a heating coil for softening the seal area of the seal, in accordance with an embodiment of the invention.

Referring to FIG. 3, an embodiment of the invention shows a portion of the seal ring and the heat treatment process for softening the wall surfaces 24, 28 of the seal legs 22, 26. Induction heating coils 50 may be wound around circumference and inner diameter of seal ring 23 such that induction heating coils 50 are in contact with sealing wall surfaces 24, 28. Induction coil leads 52 connect coils 50 to an electrical power source 54. Source 54 supplies and controls power input to the coils 50 in order to control the heat input to the wall surfaces 24, 28. Cycling between upper and lower critical transformation temperatures of the metal of seal ring 23 causes a microstructural change in the material comprising the seal ring 23. Duration of cycles may be about one hour per square inch of maximum cross section and typically only one cycle is required is performed. Critical transformation temperature is the point where significant microstructure changes occur. Since heat treatment is a function of time and temperature these microstructure changes can manifest at the lower temperature but exposed at that temperature for a longer duration or by exposing the steel to higher temperatures for a shorter period of time. These microstructure changes entail transforming Carbides from Lamellar Pearlite to Spheroidized. The critical transformation temperature range is 1340° F. to 1495° F. for AISI G1030 steel. Other grade possibilities may be AISI H4130 or H8630. Critical temperature for AISI 4130 is 1395° F. to 1490° F. and for H8630 it is 1355° F. to 1460° F. Spheroidal carbides are formed in a ferrite matrix comprising the seal ring 23. This microstructural change can extend to a finite width ("W") established by the total sealing area, which is defined by the sealing wall surfaces 24, 28, and can be limited to a subsurface depth ("D") of 0.500 inches maximum on sealing wall surfaces. In this embodiment, the width W of softened region on sealing wall surfaces 24, 28 may be fixed while the depth D can be directly proportional to duration of exposure to peak temperatures. Depth D may vary relative to amount of stock material removal that will be removed on final machining and also on the strength requirements in the sealing area. In this embodiment, seal legs 22, 26 are approximately 0.5 inches thick and the softened region can have a depth D that extends throughout (0.500 inches) the thickness of each of the legs without having a detrimental effect on performance. However, the thickness of seal legs 22, 26 may vary with application. Alternatively, the depth D could be less than the thickness of the seal legs 22, 26 and thus have a depth in a range from 0.2 to 0.5 inches.

The base material utilized for the seal in this example embodiment may be standard AISI G1030 low carbon steel with an as-rolled yield strength in a range of 40 to 50K and an ultimate tensile strength in a range of 50 to 70K. The strength of the sealing wall surfaces 24, 28 subjected to the heat treatment process described above, may be softened to obtain a yield strength in a range of 25 to 35K. The remainder of the seal ring 23 not affected by the heat treatment process retains a yield strength of approximately 60K. The base area of seal 23 from the bottom of slot 50 downward should be approximately at the original yield strength level. This variation in yield strengths allows seal ring 23 to retain mechanical load capability while improving sealabilty of the sealing wall surfaces 24, 28 due to their ability to deform more easily against wicker profiles 14, 20. Further, surface hardness of softened region may be approximately in a range from HBW 90 to about HBW 110 and other non-softened areas may have a surface hardness in approximately a range from HBW 130 to about HBW 150.

This written description uses examples to disclose the invention, including the best mode, and also to enable any person skilled in the art to practice the invention, including making and using any devices or systems and performing any incorporated methods. These embodiments are not intended to limit the scope of the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A wellhead assembly with an axis, comprising:

an outer wellhead member having a bore;

an inner wellhead member located in the bore;

opposing seal surfaces in the bore and on an exterior portion of the inner wellhead member;

a monolithic seal ring formed of a steel material and located between the inner and outer wellhead members, the seal ring having an inner annular member and an outer annular member circumscribing a portion of the inner annular member, the inner annular member having an inward facing profile and the outer annular member having an outward facing profile, the inner annular member and the outer annular member defining a pocket therebetween;

a heat treated seal surface formed in the steel material of the seal ring on at least one of the inward and outward facing profiles to define a softened portion of the seal ring having a lower yield strength than a remainder of the seal ring, the softened portion having a depth that extends only part of a distance toward the pocket; and an annular energizing ring having a lower end insertable into the pocket between the inner and outer annular members of the seal ring, so that when the lower end of the energizing ring is inserted into the pocket between the inner and outer annular members of the seal ring, the inner and outer annular members of the seal ring are urged radially apart from each other to place the heat treated seal surface into sealing engagement with the seal surface of one of the inner and outer wellhead members.

2. The assembly according to claim 1, further comprising an annular extension extending axially away from the seal ring, the extension having a surface that lands on a shoulder portion of the inner wellhead member; wherein the annular extension has a higher yield strength than the heat treated seal surface.

3. The assembly according to claim 1, wherein spheroidal carbides are within the heat treated seal surface.

4. The assembly according to claim 1, wherein the steel material of the seal ring other than in the softened portion has a yield strength in a range from approximately 1.14 to 2.0 times the yield strength of the heat treated seal surface.

5. The assembly according to claim 1, wherein at least one of the inner or outer wellhead members comprises a set of wickers formed on the seal surface, wherein the heat treated seal surface deforms on the wickers upon setting of the seal assembly.

6. The assembly according to claim 1, wherein a U-shaped pocket base of the seal ring joins the inner and outer annular members at a lower end of the pocket, wherein an extension extends downward from the pocket base, and a base nose ring is attached to the extension, and wherein the extension and the nose ring each have a yield strength that is greater than the yield strength of the heat treated seal surface.

7. The assembly according to claim 1, wherein a hardness for the heat treated seal surface is in the approximate range of HBW 90 to HBW 110; and a hardness for a remaining portion of the seal ring other than in the softened portion is in the approximate range of HBW 130 to about HBW 150.

8. The assembly according to claim 1, wherein the heat treated seal surface comprises heat treated seal surfaces on each of the inward and outward facing profiles.

9. A seal assembly for a subsea wellhead assembly, comprising:

a monolithic metal seal ring formed of a steel material for sealing between inner and outer wellhead members, in a subsea wellhead assembly, the seal ring having an inner annular member and an outer annular member circumscribing a portion of the inner annular member, the inner and outer annular members being joined at a base and having opposed wall surfaces separated from each other to define a pocket, the inner annular member having an inward facing profile and the outer annular member having an outward facing profile;

an annular energizing ring having an end insertable into the pocket between the inner and outer annular members of the seal ring, so that when the end of the energizing ring is inserted between the inner and outer annular members of the seal ring in engagement with the opposed wall surfaces, the inner and outer annular members of the seal ring are urged radially apart from each other into sealing engagement with the inner or outer wellhead members;

an annular extension extending axially away from the seal ring, the extension having a surface selectively landed on a portion of the inner wellhead member and having a shoulder in contact with the inner annular member of the seal ring; and a heat treated seal surface formed in the steel material of the seal ring on at least one of the inward and the outward facing profiles, wherein the heat treated seal surface has a lower yield strength than the base, the annular extension, and the energizing ring, and wherein the heat treated seal surface defines a softened portion in the steel material with a depth that extends only partially to the pocket, leaving the opposed wall surfaces of the pocket free of any softened portions.

10. The assembly according to claim 9, wherein spheroidal carbides are within the heat treated seal surface.

11. The assembly according to claim 9, wherein at least one of the inner or outer wellhead members comprises a set of wickers, wherein the heat treated seal surface deforms on the wickers upon setting of the seal assembly.

12. A wellhead assembly with an axis, comprising:

an outer wellhead member having a bore;

an inner wellhead member located in the bore;

opposing wickers in the bore and on an exterior portion of the inner wellhead member;

a monolithic seal ring formed of a steel material and located between the inner and outer wellhead members, the seal ring having an inner annular member and an outer annular member circumscribing a portion of the inner annular member, the inner annular member having an inward facing profile and the outer annular member having an outward facing profile, the inner annular member and the outer annular member having pocket wall surfaces that are radially spaced apart from and face each other, defining a pocket therebetween;

a heat treated seal surface formed in the steel material of the seal ring on the inward facing profile of the inner annular member and on the outward facing profile of the outer annular member, each of the heat treated seal surfaces defining a softened portion of the seal ring having a lower yield strength than a remainder of the seal ring, the softened portion of the inner annular member having a depth that is less than a radial thickness of the inner annular member, the softened portion of the outer annular member having a depth that is less than a radial thickness of the outer annular member;

the pocket wall surfaces of the inner and outer annular members being free of the heat treated seal surfaces; and an annular energizing ring having a lower end insertable into the pocket between the inner and outer annular members of the seal ring, so that when the lower end of the energizing ring is inserted into the pocket into engagement with the pocket wall surfaces, the inner and outer annular members of the seal ring are urged radially apart from each other to place the heat treated seal surface of the outer annular member into sealing and deforming engagement with the wickers in the bore and the heat treated seal surface of the inner annular member into sealing and deforming engagement with the wickers on the exterior of the inner wellhead member.

* * * * *